US005927609A

United States Patent [19]

Scarpa et al.

[11] Patent Number: 5,927,609

[45] Date of Patent: Jul. 27, 1999

[54] PORTABLE CONVERGENT SPRAY GUN FOR APPLYING COATINGS

[75] Inventors: Jack Scarpa; Terry Hall, both of Huntsville; Quintin Lundy, New Market; Beth Van Wavern; Matthew Kelly, both of Huntsville, all of Ala.

[73] Assignee: USBI, Co., Kennedy Space Center, Fla.

[21] Appl. No.: 08/994,768

[22] Filed: Dec. 19, 1997

[51] Int. Cl.[6] ..... B05B 1/28

[52] U.S. Cl. ..... 239/290; 239/146; 239/150; 239/151; 239/422

[58] Field of Search ..... 239/146, 150, 239/151, 159, 172, 290, 650, 422

[56] References Cited

U.S. PATENT DOCUMENTS

| | | | |
|---|---|---|---|
| 2,673,090 | 3/1954 | Blumberg | 239/150 X |
| 3,096,225 | 7/1963 | Carr et al. | 239/151 X |
| 4,720,044 | 1/1988 | Stemwedel, Jr. | 239/290 X |
| 4,848,659 | 7/1989 | Tadych | 239/146 X |
| 4,893,751 | 1/1990 | Armstrong | 239/150 |
| 5,044,557 | 9/1991 | Smith | 239/290 X |
| 5,116,425 | 5/1992 | Ruef | 239/172 X |
| 5,579,998 | 12/1996 | Hall et al. | 239/9 |

*Primary Examiner*—Andres Kashnikow
*Assistant Examiner*—Robin O. Evans
*Attorney, Agent, or Firm*—Norman Friedland

[57] ABSTRACT

A wand with a convergent spray end effector is utilized in a portable coating system for roofs, skid proof walk-ways and the like and includes a system of transporting the resin and dry filler materials to the end effector by including a movable cart that is capable of being raised that carries the pumps, meters, eductor and its dry powder feeder and optional pressure pots for the resin and including the necessary hoses to convey the materials to the wand. The wand includes the trigger and the necessary controls for effectuating the spray of the coating on the surface of the substrate.

7 Claims, 3 Drawing Sheets

PORTABLE CONVERGENT SPRAY GUN FOR APPLYING COATINGS

TECHNICAL FIELD

This invention relates to apparatus for applying coatings to a surface and particularly to a portable spray gun for developing a convergent spray for applying a protective coating to surfaces such as roofs of buildings, walls, skid resistant walk ways and the like.

BACKGROUND OF THE INVENTION

U.S. Pat. No. 5,5645,241 granted to Mathias et al on Oct. 15, 1996 entitled "Convergent End Effector" and U.S. Pat. No. 5,579,998 granted to Hall et al on Dec. 3, 1996 entitled "Method For Coating A Substrate With A Reinforced Resin Matrix" on which the inventor Jack G. Scarpa is a co-inventor and which these patents and this patent application are commonly assigned to USBI. Both of these references disclose a spray gun that utilized a nozzle that is designed to configure the spray emitted by the nozzle into an atomized convergent plume of liquid resin and targets the plume with reinforced filler material downstream of the nozzle to mix and wet the filler just prior to being applied to the surface of the substrate. In other words the reinforcing material is entrained around the atomized liquid resin flow and is caused to be captured thereby, mix therewith and become an homogeneously wetted coating material that after impact with the substrates becomes cured into a substantially reasonably thick coating exhibiting good strength and resistance characteristics. The gaseous transport stream together with the eductor deliver the ingredients in the proper proportions and the air stream for causing the atomization and mixing to provide the proper amounts of material to assure that the coating is uniform and consistent. Heating is applied in the proper sequence to assure that the viscosity is at the proper level to assure evenness of flow.

There are no commercially available or otherwise available spray systems that can convergently spray low VOC coatings with environmentally compatible fillers to roofs and other substrates requiring tough, water-resistant surfaces. I have found that I can provide a portable system that provides a tough, homogeneous low-VOC one or two part coating which is formed on the exterior of the spray gun's spray nozzle.

The unit is comprised of a portable cart which is capable of mixing and applying one or two-part coatings and a Class Five (non-uniform size/shape fibrous and flocculent) bulk solids with convergent spray technology process. The cart may be lifted to the roof, for example, by hoisting rings. Five or fifty-five gallon coating drums with low pressure barrel pump can remain at ground level. Drum pumps supply the coating components to the cart gear pumps that are controller based. The gear pumps supply fluid to the end of the spray gun where the resin is atomized and combined with dry materials at the convergent spray nozzle technology configuration. On the spray cart recycled dry materials, are supplied to a gravity fed hopper with a one or two-inch eductor and feed hopper tray. Dry compressed air supplied from the ground assists delivery of the filler material from the hopper through an eductor system to the spay gun or wand. The one or two-part acrylic or polyurethane coating is atomized as it exits the nozzle where in converges with fillers that may be of recycled materials to form a tough, homogenous, water-resistant coating. This portable system can also be utilizes as an application system for skid resistance coatings using either recycled rubber, aggregates or a combination for walkways, loading dock, recreational areas, etc.

Without intending to be a limitation to the scope of this invention, among the advantage of the present invention are the following:

1) portability/ease of application;
2) resin and filler simultaneous in the convergent spray technology application;
3) ability to protect several roof types with one method;
4) significant reduction in waste and hazardous materials;
5) use of recycled materials with no negative impact on the environment;
6) highly loaded fillers that are characteristically inexpensive requires less resin which is an expensive ingredient; and
7) capability of spraying one or two part resins and spray a variety of fillers with the same unit.

DISCLOSURE OF THE INVENTION

An object of this invention is to provide a portable convergent spray system for applying coating to the surface of a roof, walls, walk ways and the like.

A feature of this inventions the use of the convergent spray gun that allows for mixing the filler and liquid resin in a convergent atomized spray on the exterior of the spray gun's nozzle just prior to the application of the coating on the surface intended to be sprayed.

A still further feature of this invention is the remote location of the spray gun or wand and the supply of the ingredients of the coating material including a pumping system to flow the ingredients to the remote spray gun so that the resin is emitted through the nozzle, atomizing air transports the liquid resin into a convergent plume and the filler is admitted into the low pressure zone of the atomized plume just prior to being applied to the surface being coated.

The foregoing and other features of the present invention will become more apparent from the following description and accompanying drawings.

These figures merely serve to further clarify and illustrate the present invention and are not intended to limit the scope thereof.

BEST MODE FOR CARRYING OUT THE INVENTION

While this invention is described in the preferred embodiment of a system for applying coatings to the roof of a building, it is to be understood that the principles of this invention can be utilized to apply coatings to other structures.

Figure 1:
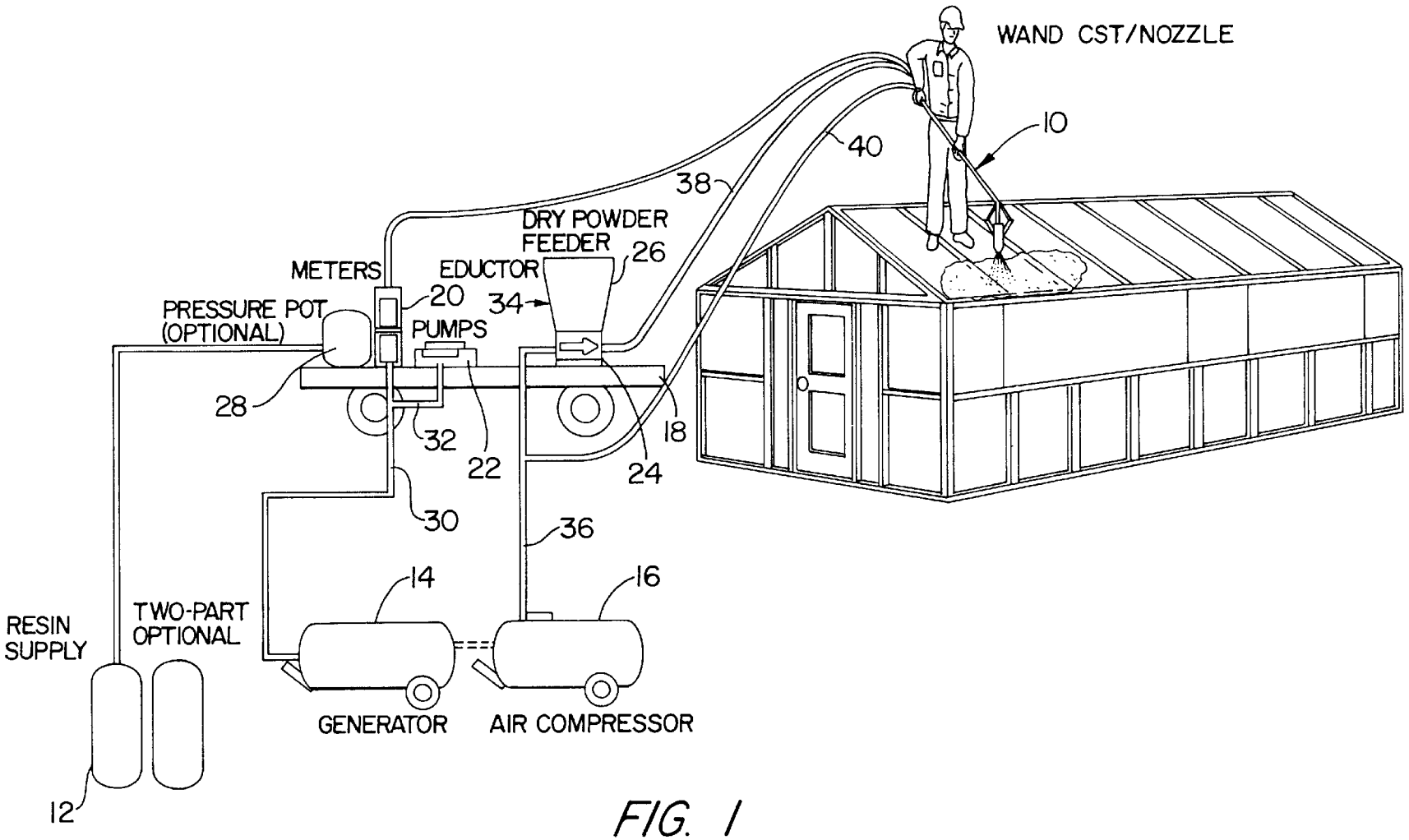
FIG. 1 is a schematic view illustrating the set-up of this invention.
Figure 2:
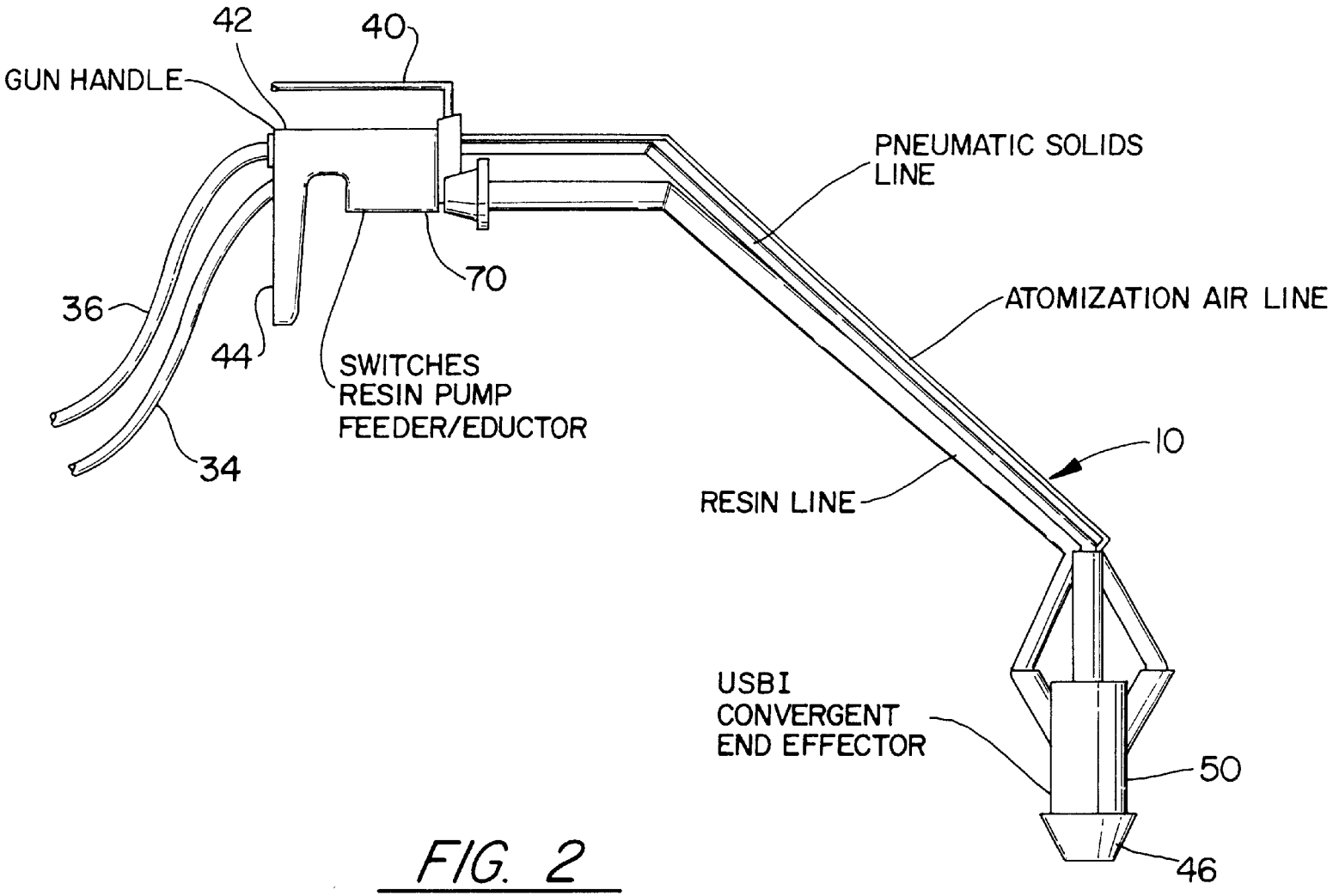
FIG. 2 is a schematic view in elevation illustrating the wand applicator of this invention.
Figure 3:
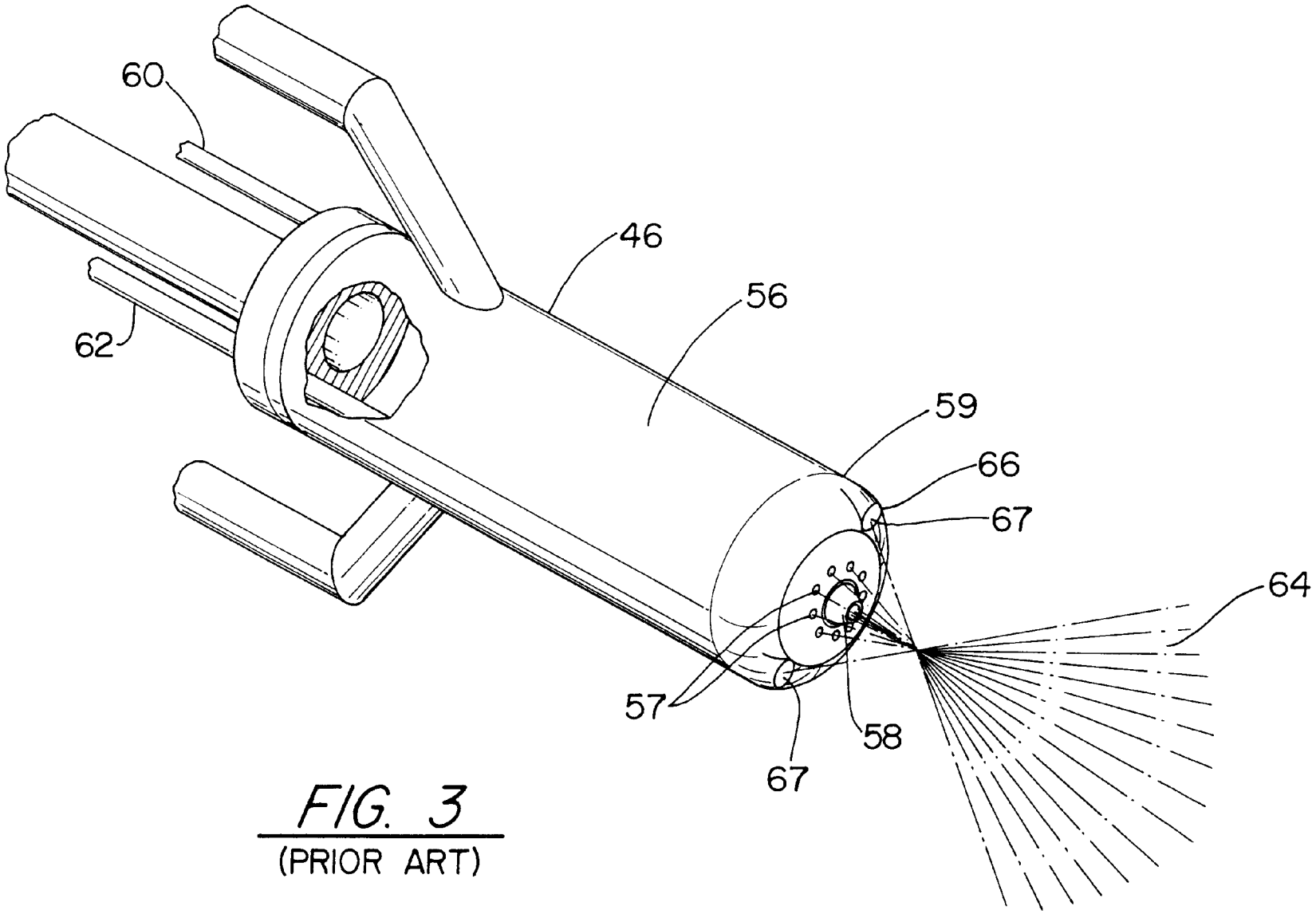
FIG. 3 (PRIOR ART)
FIG. 3 is a prior art end effector utilized on the wand applicator.

The invention can be best understood by referring to FIGS. 1 through 3 showing the wand applicator generally illustrated by reference numeral 10, the ground support support equipment including the resin supply 12, electric generator 14 and air compressor 16. A cart 18 that can be suitably lifted in a well known manner by hoists is shown supporting the meters 20, electrically driven pumps 22, the eductor 24 and the dry powder gravitational feed 26. Suitable conduits, cables and lines are shown that interconnect the various components in well known manners. The generator 14 which may be a gas operated motor driven electric generator generates electricity is connected to the meters 20 and electrically driven pump 22 via line 30 and branch line 32 for powering the solenoid operated metering valves 20 and pump 22. The pressure pot 28 supplies material to the pump 22 which, in turn, supplies the material to the spray wand 10 via the meters 20 and line or hose 34. The air compressor 16 supplies air to the eductor via line 36 which transports the powder filler material to the wand 10 via line or hose 38 and compressed air is supplied directly to the wand 10 via line or hose 40. The system may require small drum pumps to supply the coating components to the pressure pots and cart gear pumps which is controlled by a suitable controller 42 mounted on the handle 44 of wand 10 (see FIG. 2). The gear pumps 22 supply the resin to the end of the spray wand 10 where the resin is atomized through the end effector 46 (see FIG. 3) of the convergent spray gun 50. The known end effector is disclosed in U.S. Pat. No. 5,565,241 granted on Oct. 15, 1996 to Mathias et al entitled "Convergent End-Effector" and Jack G. Scarpa, the co-inventor of this patent application, is a named co-inventor, and which is commonly assigned to UBI which is incorporated herein by reference. Suffice it to say that the end effector 46 includes a cylindrical hollow case 56 for receiving the liquid resin and emitting the liquid resin through the central orifice 58. A plurality of circumferentially spaced holes 57 surround the central orifice 58 formed in end cap 59 and are supplied atomizing air via lines 60 and 62 for atomizing the liquid resin and forming a convergent spray or plume 64. A hollow cylinder is concentrically and co-axially disposed relative to case 56 and is spaced therefrom to form an annular passage 66 for conveying the solid filler particles to the plume exterior of the cap 59 for directing the filler particles into the low pressure zone of the plume 64. Shaping holes 67 may be provided to shape the plume as described in the U.S. Pat. No. 5,565,241, supra and for further details of this device reference should be made to this patent.

The resin is either the one or two part type described in U.S. Pat. No. 5,565,241, supra, and if a two part type is utilized an additional supply drum, additional line or hose and optional pressure pot would be utilized.

The dry filler may include recycled dry material, such as granular rubber, small fibers, and the like and are supplied to the suitable and well known gravity fed hopper 26 and eductor 24, (which may be either ½, one or two inches, predicated on the type of material). As is apparent from the foregoing the dry compressed air from compressor 16 via lines 36 and 38 assists the delivery of the filler material from the hopper to the spray wand 10. Atomizing air is supplied to the wand from compressor 16 via the line 40. Suitable switches 42 for controlling the resin pump and feeder/eductor are suitably mount directly on the spray gun in any well known manner. As shown in FIG. 1 the operator can stand on the roof of the building itself or stand or the cart 18 depending on the application.

What has been shown by this invention is a system for applying a coating to a surface that is portable and utilizes the convergent spray technology. The low VOC one or two part coating which is atomized as it exits the central orifice 58 where it converges with the cost efficient recycled fillers to form a tough homogeneous, water-resistant coating. As one skilled in this art will appreciate, the portable system can be utilized as an application system for skid resistance coatings using either recycled rubber or aggregates. The applicator can also be utilized with other types of filler materials and/or resins for walkways, loading docks, recreational areas and the like.

Although this invention has been shown and described with respect to detailed embodiments thereof, it will be appreciated and understood by those skilled in the art that various changes in form and detail thereof may be made without departing from the spirit and scope of the claimed invention.

We claim:

1. A portable apparatus for applying coating to a surface including an end-effector attached to a wand for application of the coating to the surface intended to be coated, a portable cart for supporting an eductor and feed hopper for supplying material to said end-effector, means for conveying a liquid resin to the end-effector, an electric generator remote from said cart, a compressor remote from said cart for generating compressed air, conduit means for transporting the material in the eductor to said end-effector, and pump on said cart, additional conduit means for transporting said liquid resin to said end effector and said pump being supplied electricity from said electric generator, said end effector having a nozzle with a central aperture connected to said means for conveying liquid resin for discharging said liquid resin therefrom, said nozzle including a plurality of holes in said nozzle surrounding said central aperture for discharging said compressed air for atomizing said liquid resin and forming a plume adjacent the end of said nozzle, and passage means disposed in said nozzle for discharging said material from said hopper in said plume, and said wand being held by the operator to apply said coating to the substrate intended to be coated.

2. A portable apparatus for applying coating to a surface as claimed in claim 1 including a pressure pot for pressurizing said liquid resin prior to being conducted to said end-effector.

3. A portable apparatus for applying coating to a surface as claimed in claim 1 including meters to meter the amount of liquid resin being supplied to said end-effector.

4. A portable apparatus for applying coating to a surface as claimed in claim 2 including trigger means on the wand for actuating and deactuating said compressor and said pump.

5. A portable apparatus for applying coating to a surface as claimed in 4 including switch means attached to said wand for energizing said pump and said eductor.

6. A portable apparatus for applying coating to a surface as claimed in claim 5 wherein said material is a dry filler.

7. A portable apparatus for applying coating to a surface as claimed in claim 6 wherein said dry filler is taken from the group consisting of rubber or fibers.

* * * * *